US007803007B1

(12) United States Patent
Chou

(10) Patent No.: US 7,803,007 B1
(45) Date of Patent: Sep. 28, 2010

(54) CONNECTING TERMINAL FOR A CABLE

(76) Inventor: Ming-Yi Chou, No. 5, Ln. 112, Hanqing St., Fengshan City, Kaohsiung County (TW)

( * ) Notice: Subject to any disclaimer, the term of this patent is extended or adjusted under 35 U.S.C. 154(b) by 0 days.

(21) Appl. No.: 12/709,480

(22) Filed: Feb. 20, 2010

(30) Foreign Application Priority Data

Dec. 7, 2009 (TW) ..... 98141984 A

(51) Int. Cl.
*H01R 11/20* (2006.01)

(52) U.S. Cl. ..... 439/441

(58) Field of Classification Search ..... 439/441, 439/439, 796; 174/87, 94 R, 84 S
See application file for complete search history.

(56) References Cited

U.S. PATENT DOCUMENTS 5,454,730 A * 10/1995 Tozuka ..... 439/438
5,580,284 A * 12/1996 Laricchia ..... 439/783
5,975,940 A * 11/1999 Hartmann et al. ..... 439/441
6,548,761 B1 * 4/2003 Wang ..... 174/74 R
7,150,646 B2 * 12/2006 Trumper ..... 439/441
7,175,469 B1 * 2/2007 Daily et al. ..... 439/441

* cited by examiner

*Primary Examiner*—T C Patel
*Assistant Examiner*—Phuong Nguyen

(57) ABSTRACT

A cable connecting terminal has a conductive column in a terminal box, a plurality of plurality of steel elastic sheets around the conductive column, and arc slots on the conductive column corresponding to the plurality of steel elastic sheets. A conductive end of the cable inserted into the terminal box through the first or second cable hole, the conductive end of the cable is pressed by the pressing portions of the plurality of steel elastic sheets and tightly contacts the arc slot of the conductive column and is secured by the one-way securing portions of the plurality of steel elastic sheets.

3 Claims, 6 Drawing Sheets

CONNECTING TERMINAL FOR A CABLE

BACKGROUND OF THE INVENTION

1. Field of the Invention

The present invention relates to a connecting terminal for a cable, and more particularly to a cable connecting terminal which provides improved conductivity and safety.

2. Description of the Related Art

A typical cable connection is carried out by twisting the conductive wires of the cables together and then covering them with electrical tape. However, this connection is inconvenient and dangerous because the tape may lose its adhesive ability.

In order to improve the above issue, a cable connection terminal has been developed, such as the terminal disclosed in German patent application serial No. 200610019150 shown in FIG. 1-FIG. 3. This cable connection terminal comprises a terminal box 10; inside the terminal box 10 is a sheet spring 16 and a current bus. One opened end of the terminal box 10 has a panel 11. The panel 11 has a plurality of cable holes 12, 13 and 14, and a spring tongue 21 and a window 211 are formed on the sheet spring 16 corresponding to each cable hole 12, 13 and 14.

As shown in FIG. 2 and FIG. 3, the cable 15 is stripped to expose a suitable length of conductive wire 18, and the conductive wire 18 is inserted through the cable hole 12 on the panel 11 into the terminal box 10. The conductive wire 18 of the cable 15 then is pressed by a free end 20 of the spring tongue 21 through the window 211, such that the conductive wire 18 of the cable 15 tightly contacts a free end 177 of the current bus 17. With the current bus 17, different cables 15 inserted in the terminal box 10 are connected. Furthermore, the free end 20 of the spring tongue 21 provides a one-way securing effect to prevent the cable 15 from being pulled out of the terminal box 10. Therefore, the connection between the two cables 15 is established.

However, although the above-mentioned cable terminal provides an improvement over the above-indicated issue, the conductive wire 18 of the cable 15 only contacts the free end 20 of the spring tongue 21 and the freed end 171 of the current bus 17 (as shown in FIGS. 2 and 3). Therefore, the very limited contact area causes poor conductivity and high temperatures, which may result in elastic degradation of the spring tongue 21 and affect the contact between the free end 20 of the spring tongue 21, the current bus 17 and the cable 15. Sometimes the cable 15 may even escape from the terminal box which can be dangerous.

Furthermore, the above-mentioned cable terminal has only one panel 11 with the cable holes 12, 13 and 14; therefore, only a cable 15 from the same direction can be directly inserted into the terminal box 10; a cable 15 from another direction needs to be folded or bent to be inserted into the terminal box 10, which leads to clutter.

Therefore, it is desirable to provide a connecting terminal for a cable to mitigate and/or obviate the aforementioned problems.

SUMMARY OF THE INVENTION

An objective of the present invention is to provide a connecting terminal for a cable.

In order to achieve the above-mentioned objectives a cable connecting terminal comprises a terminal box, a conductive column and a plurality of steel elastic sheets, wherein the terminal box has a closed face with a plurality of first cable holes at one end and an opened face at the other end capable of being covered by a cap; the conductive column disposed at a center position of the terminal box and having a plurality of axial arc slots on a peripheral surface, each arc slot corresponding to each first and second cable hole; the plurality of steel elastic sheets disposed in the terminal box and corresponding to the arc slots of the conductive column, one end of each steel elastic sheet adjacent to the first and second cable hole bent to form a one-way securing portion, and the other end bent to form a pressing portion. Furthermore, with the above-mentioned structure, a conductive end of the cable inserted into the terminal box through the first or second cable hole, the conductive end of the cable is pressed by the pressing portions of the plurality of steel elastic sheets and tightly contacts the arc slot of the conductive column and is secured by the one-way securing portions of the plurality of steel elastic sheets.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
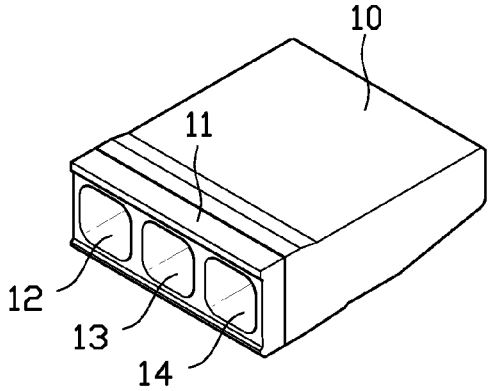
FIG. 1 is a perspective view of a prior art cable connecting terminal.
Figure 2:
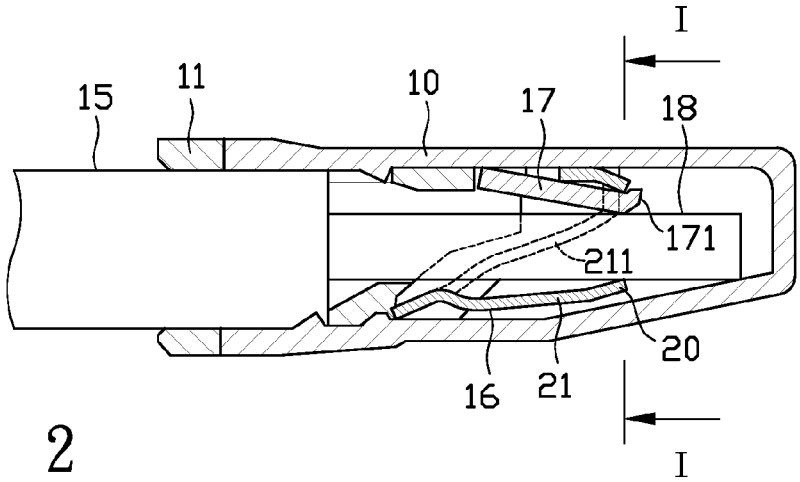
FIG. 2 is a cross-sectional view illustrating usage of the prior art cable connecting terminal.
Figure 3:
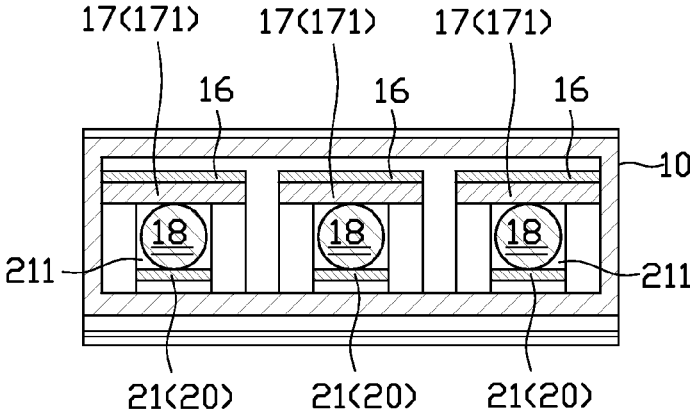
FIG. 3 is a cross-sectional drawing along a line I-I shown in FIG. 2.
Figure 4:
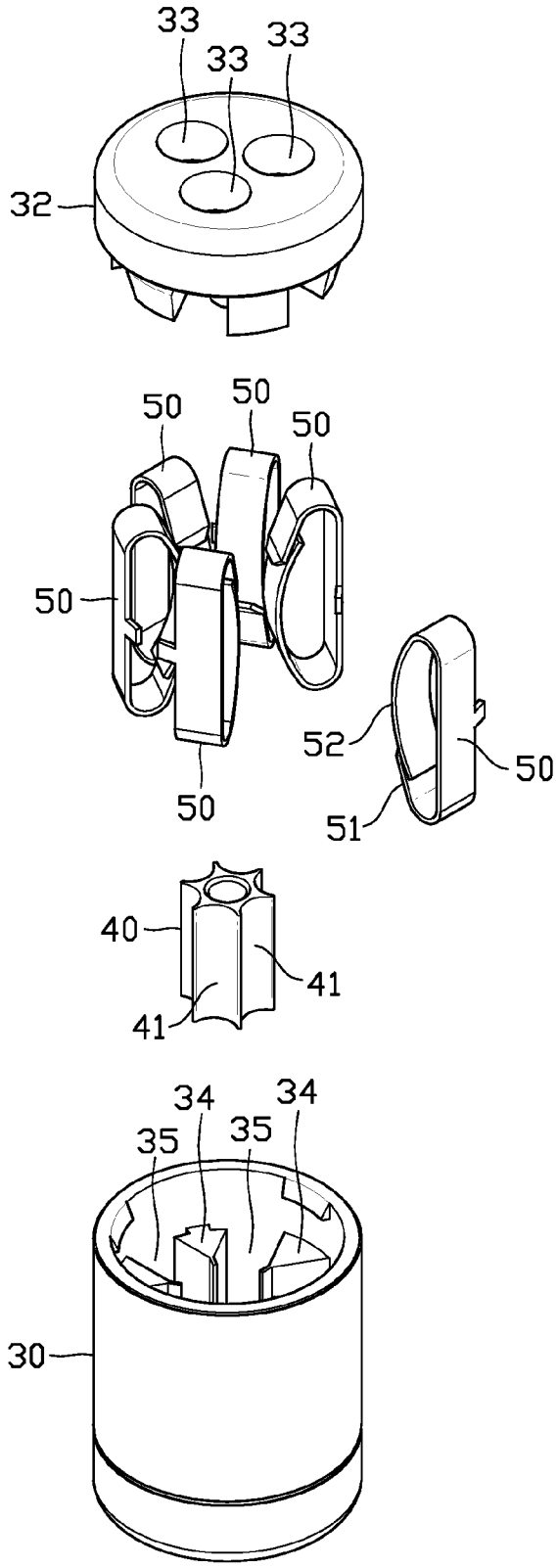
FIG. 4 is an exploded perspective view of an embodiment of the present invention.

As shown in FIG. 4, an embodiment cable connecting terminal comprises a terminal box 30, a conductive column 40 and a plurality of steel elastic sheets 50.

Figure 5:
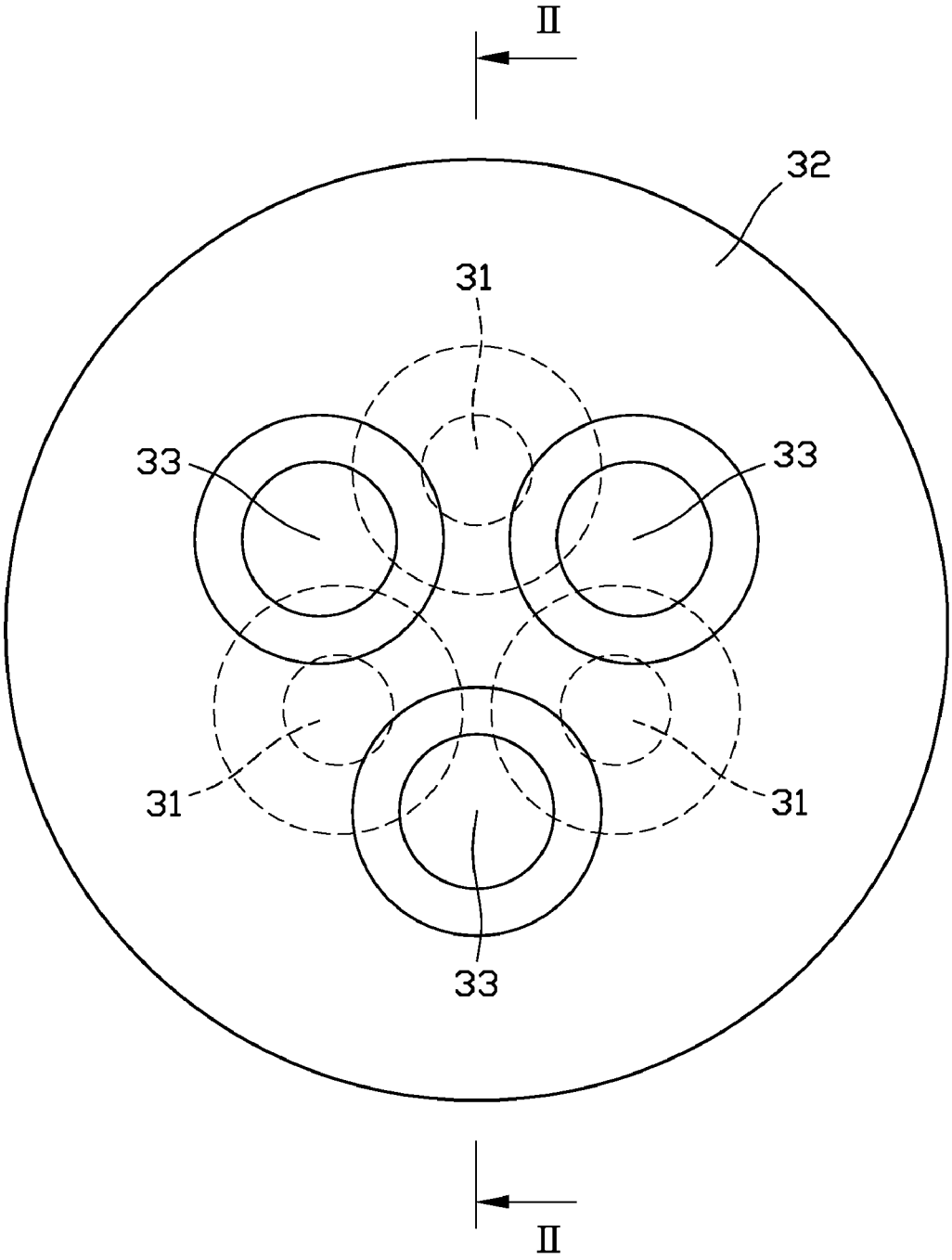
FIG. 5 is a plan view of an embodiment of the present invention.
Figure 6:
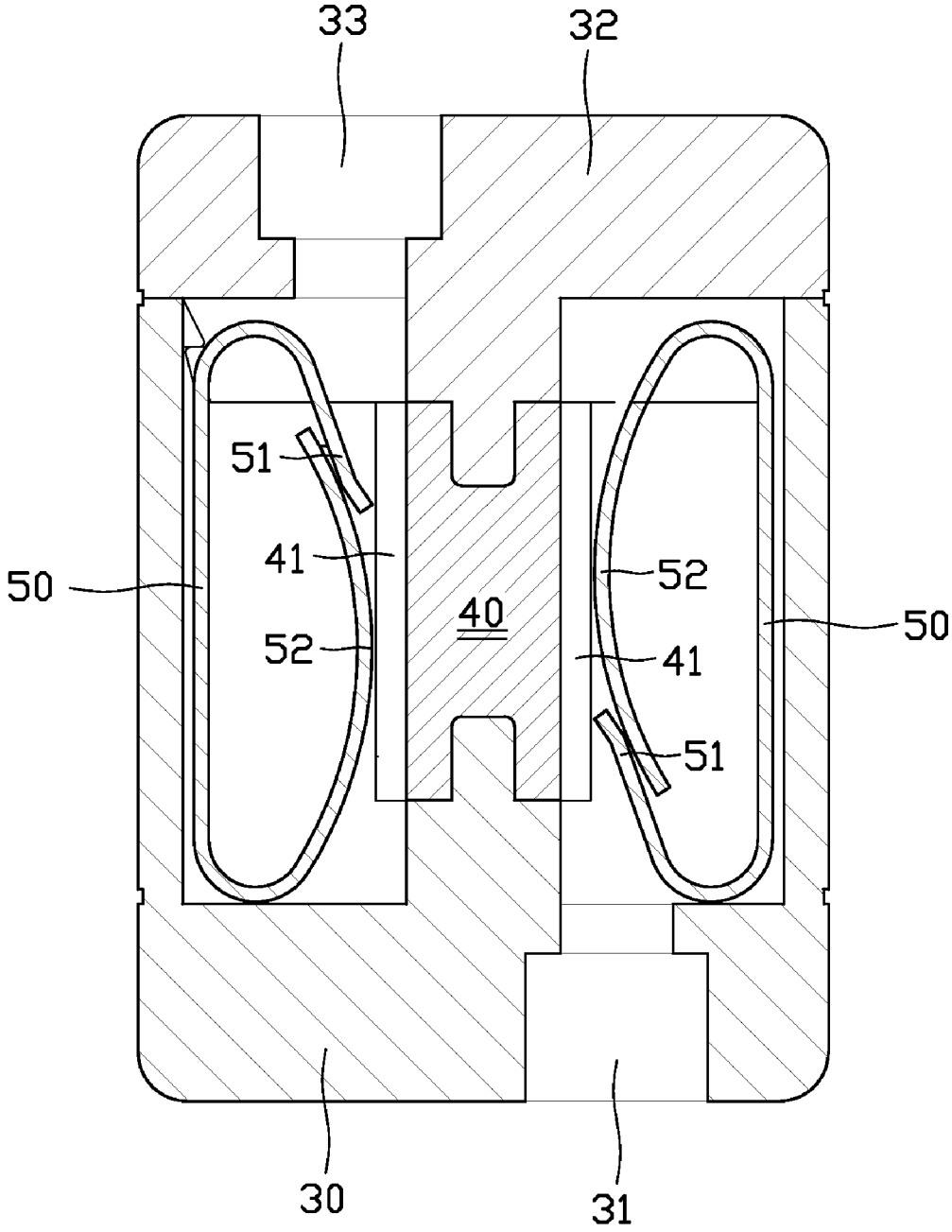
FIG. 6 is a cross-sectional view along a line II-II shown in FIG. 5.

The terminal box 30 (with further reference to FIG. 5 and FIG. 6) has a closed face with a plurality of first cable holes 31 at one end and an opened face at the other end capable of being covered by a cap 32. The cap 32 of the terminal box 30 includes a plurality of second cable holes 33, and the plurality of second cable holes 33 are alternatively arranged with the plurality of the first cable holes 31 on the closed face. The terminal box 30 has a plurality of spacing edges 34 on an inner wall providing a plurality of slots 35 in the terminal box 30, and the plurality of slots 35 accept the plurality of steel elastic sheets 50. Each slot 35 corresponds to one cable hole 31 or 33.

A conductive column 40 (referring to FIG. 5) is disposed at a central position of the terminal box 30 and has a plurality of axial arc slots 41 on its external peripheral surface; each arc slot 41 corresponds to each first and second cable hole 31, 33 and each slot 35 in the terminal box 30.

The plurality of steel elastic sheets 50 (referring to FIG. 5) are individually disposed in each slot 35 in the terminal box 30. One end of each steel elastic sheet 50 adjacent to the first and second cable holes 31, 33 is bent to form a one-way securing portion 51, and the other end is bent to form a pressing portion 52.

Figure 7:
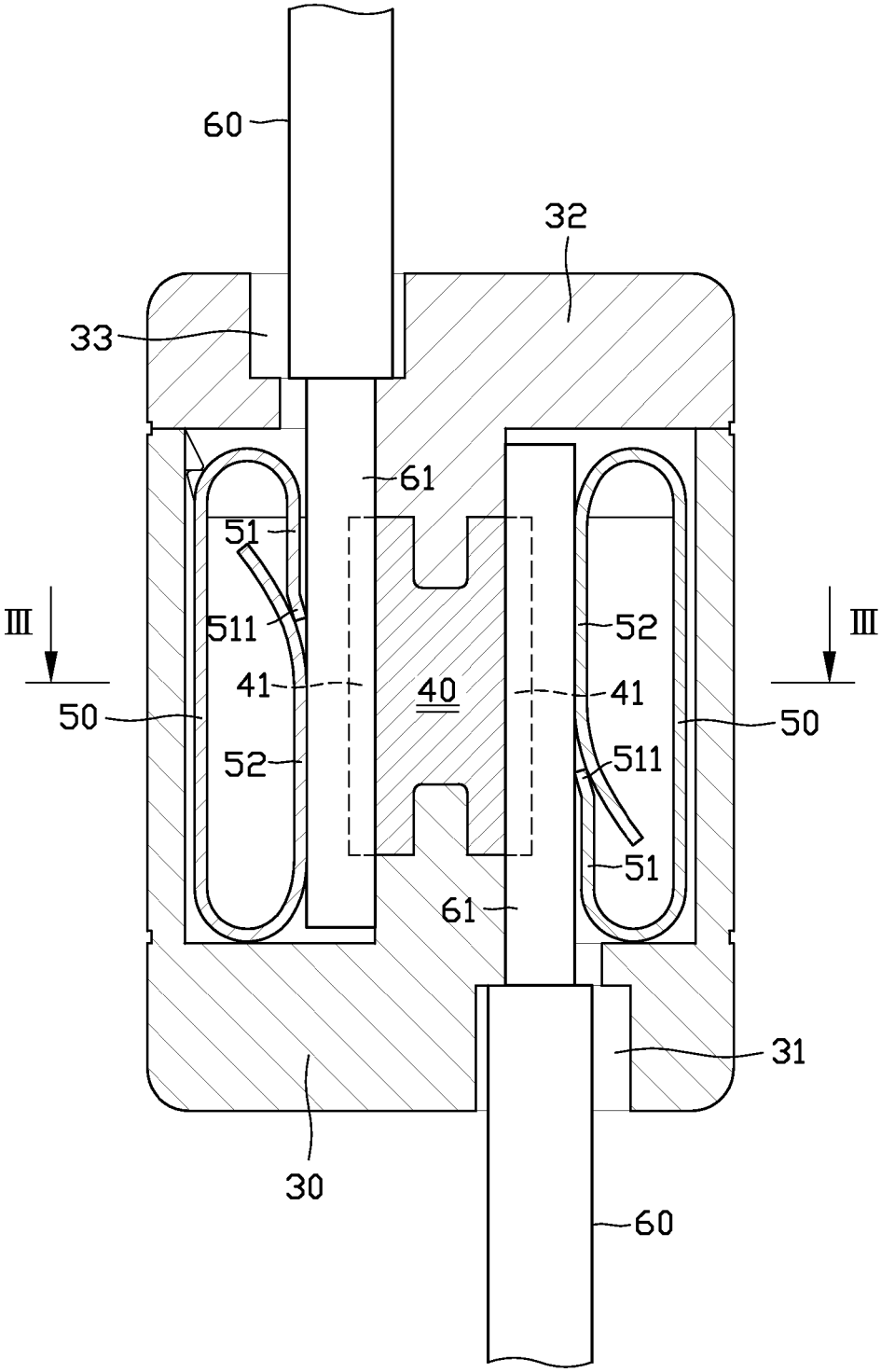
FIG. 7 illustrates usage of an embodiment of the present invention.
Figure 8:
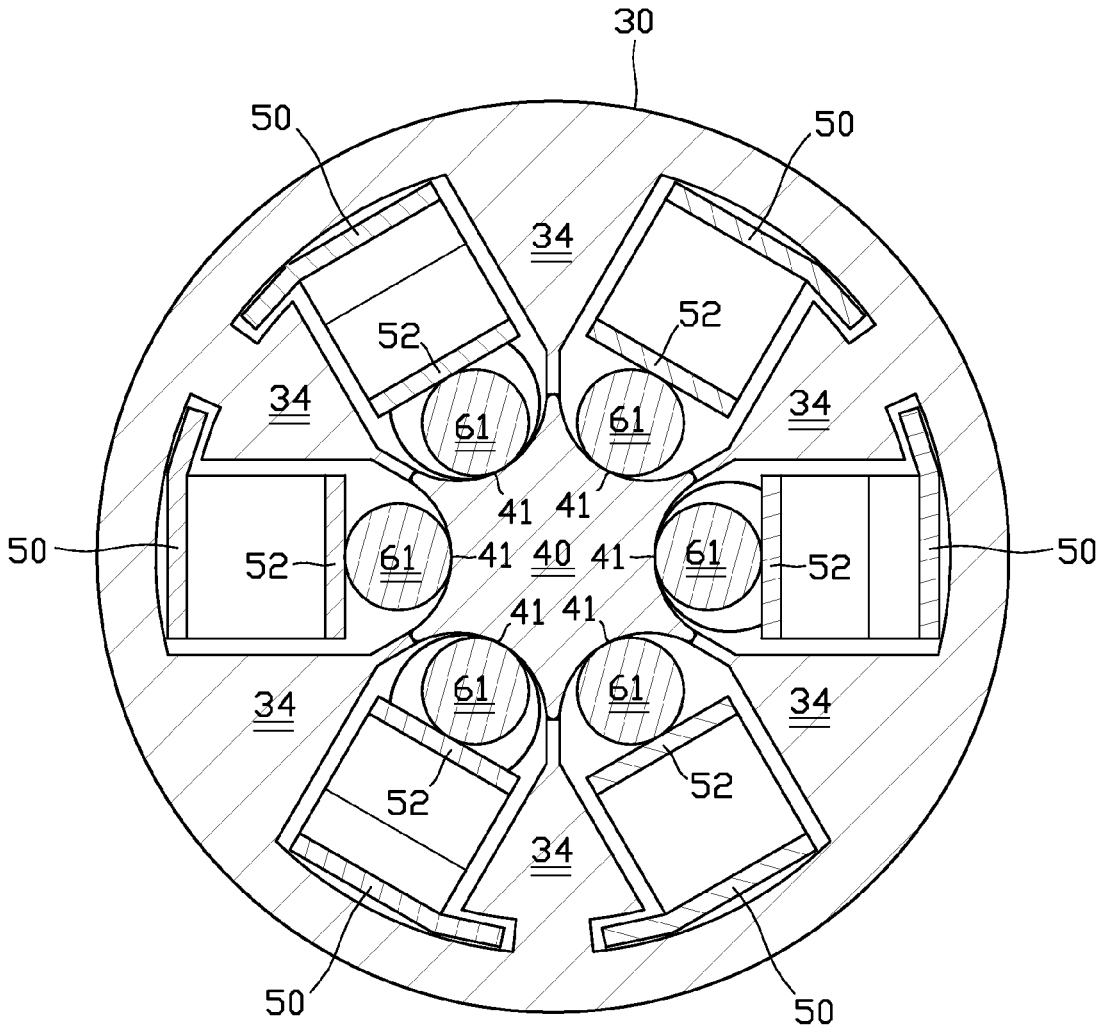
FIG. 8 is a cross-sectional drawing along a line III-III shown in FIG. 7.

As shown in FIG. 7 and FIG. 8, with the above-mentioned structure, a conductive end 61 of the cable 60 is exposed by stripping and then inserted into the terminal box 30 through the first or second cable hole 31, 33; the conductive end 61 of the cable 60 is pressed by the pressing portion 52 of the plurality of steel elastic sheets 50 and tightly contacts the arc slot 41 of the conductive column and is secured by a free end 511 of the one-way securing portion 51 of the steel elastic sheet 51. Therefore, the cable 60 is prevented from be pulled from the terminal box 30 in an opposite direction, and the two individual cables 60 are connected together.

Accordingly, the connecting terminal disclosed in the present invention has the following benefits: 1. the arc slot 41 of the conductive column 40 provides a larger area contact area to directly contact the conductive end 61 of the cable 60, which can improve the conductivity of the connection. 2. With the pressing portion 52 of steel elastic sheet 50, the conductive end 61 of the cable 60 can smoothly and tightly contact the arc slot 41 of the conductive column 40, which also improves the conductivity. 3. The terminal box 30 has the closed face with the plurality of first cable holes 31 at one end, the cap 32 of the terminal box 30 includes the plurality of second cable holes 33, and thus the terminal box 30 is able to accept more than one cable 60.

Although the present invention has been explained in relation to its preferred embodiment, it is to be understood that many other possible modifications and variations can be made without departing from the spirit and scope of the invention as hereinafter claimed.

What is claimed is:

1. A connecting terminal for a cable comprising: a terminal box, a conductive column and a plurality of steel elastic sheets, wherein the terminal box has a closed face with a plurality of first cable holes at one end and an opened face at the other end capable of being covered by a cap;

the conductive column disposed at a center position of the terminal box and having a plurality of axial arc slots on a peripheral surface, each arc slot corresponding to each first and second cable hole;

the plurality of steel elastic sheets disposed in the terminal box and corresponding to the arc slots of the conductive column, one end of each steel elastic sheet adjacent to the first and second cable hole bent to form a one-way securing portion, and the other end bent to form a pressing portion;

wherein with the above-mentioned structure, a conductive end of the cable inserted into the terminal box through the first or second cable hole, the conductive end of the cable is pressed by the pressing portions of the plurality of steel elastic sheets and tightly contacts the arc slot of the conductive column and is secured by the one-way securing portions of the plurality of steel elastic sheets.

2. The connecting terminal for a cable as claimed in claim 1, wherein the cap of the terminal box includes a plurality of second cable holes, and the plurality of second cable holes are alternatively arranged with the plurality of the first cable holes on the closed face.

3. The connecting terminal for a cable as claimed in claim 1, wherein the terminal box has a plurality of spacing edges in an inner wall providing a plurality of slots in the terminal box, and the plurality of slots accept the plurality of steel elastic sheets.

* * * * *